US005379956A

United States Patent [19]

Schmuck

[11] Patent Number: 5,379,956

[45] Date of Patent: Jan. 10, 1995

[54] SPOOL HOLDER FOR THREAD SPOOLS

[75] Inventor: Peter Schmuck, Obertshausen, Germany

[73] Assignee: Karl Mayer Textilmaschinenfabrik GmbH, Obertshausen, Germany

[21] Appl. No.: 158,521

[22] Filed: Nov. 29, 1993

[30] Foreign Application Priority Data

Dec. 3, 1992 [DE] Germany ..... 4240663

[51] Int. Cl.[6] ..... B65H 49/06; B65H 67/04

[52] U.S. Cl. ..... 242/130; 242/131.1

[58] Field of Search ..... 242/130, 130.1, 131, 242/131.1, 129.5, 129.7, 129.71, 134, 141

[56] References Cited

U.S. PATENT DOCUMENTS

| | | | |
|---|---|---|---|
| 2,013,770 | 9/1935 | Stein et al. | 242/131.1 |
| 2,615,652 | 10/1952 | Johnson | 242/130 |
| 2,632,612 | 3/1953 | Stange | 242/130 |
| 3,140,840 | 7/1964 | Hunsinger et al. | 242/130 |
| 3,460,689 | 8/1969 | Furst | 242/131.1 X |
| 3,858,827 | 1/1975 | Glassbrook | 242/131 |
| 4,552,321 | 11/1985 | Raeckelboom | 242/130 |
| 4,728,055 | 3/1988 | Wright, Jr. et al. | 242/130 |
| 5,060,884 | 10/1991 | Rapp | 242/131.1 |
| 5,203,518 | 4/1993 | Morgan | 242/130 |

*Primary Examiner*—Stanley N. Gilreath
*Attorney, Agent, or Firm*—Omri M. Behr

[57] ABSTRACT

A spool holder having a carrier arm (7) can carry thread spools having cylindrical or conical cores (3). This arm has a contact surface (8) for the core (3) and at the distal end thereof, an angled surface (10). This angled surface diverges at the free end of the carrier arm 7. Carrier arm 7 also has a freely hanging lever(11, 13) hinged about its upper end. The lever has such a length that when the core face (4) rides on the inclined surface (10), the lever contacts the core wall. This gives rise to a secure clamping of the core during use, coupled with an automatic freeing of the empty core when the carrier arm downwardly tips.

9 Claims, 3 Drawing Sheets

SPOOL HOLDER FOR THREAD SPOOLS

BACKGROUND OF THE INVENTION

1. Field of the Invention

A spool holder for holding thread spools with a cylindrical and/or conical core employs a carrier arm oriented substantially horizontal; the carrier arm has(a) a contact surface for supporting the upper portion of the core wall, (b) an abutment for the front face of the core, and (c) at least one support element for contacting the lower portion of the core wall.

2. Discussion of Related Art

In order to hold spools which are in use securely upon a spool holder, spring loaded arrangements are generally used wherein the core is clamped onto the carrier arm. Thus, the art discloses, in German Utility Model G 90 00 818.9, a spool holder of the general type described above, wherein the support element is formed by coiled spring fingers which press the upper portion of the core onto the support surface of the carrier arm, so the core face rests securely behind an abutment surface running perpendicular to the carrier axis.

The removal of the empty cores thus occurs by lifting the core face surface and applying an axial force to overcome the spring force.

Even when there is no stop and the core is held merely by spring force against the carrier arm, it is necessary to take special steps to clear the cores from the carrier. For the circulating creel of U.S. Pat. No. 5,060,844, a stripping means is required for grasping the empty core as the appropriate carrier arm swings downwardly from its horizontal orientation.

Accordingly, it is an object of the present invention to provide a spool holder of the type described hereinabove, wherein the spool is securely held on the carrier arm during use, but nevertheless the empty spool can be readily discharged by a simple downward tilting of the carrier arm.

SUMMARY OF THE INVENTION

In accordance with the illustrative embodiments demonstrating features and advantages of the present invention, there is provided a spool carrier for supporting thread spools. These thread spools can have either a cylindrical or conical core. The core has an inner core wall terminating in a distal edge. The carrier includes a carrier arm, adapted to be used in a horizontal orientation. The carrier arm has a support surface for supporting the inner core wall. The carrier arm has an abutment for engaging the distal edge of the core. The abutment has an inclined surface, which diverges in a distal direction along the carrier arm. The carrier also has at least one support element for interacting with a bottom portion of the inner core wall. The support element includes at least one freely hanging lever having an upper end hinged in the carrier arm and being sized in length to interact with the inner core wall in response to the distal edge of the core climbing the abutment.

By employing such apparatus, an improved carrier is achieved wherein the abutment is provided by an angled surface, which rises towards the distal end of the carrier arm. The upper end of the preferred support element or lever is hingably attached to the carrier arm and has such a length that when the end face of the core lies on the angled surface, the lever grasps the core wall.

The danger of an unintended discharge of the thread spool from the thread holder only occurs when an axial force acts upon the spool, as is the case for a creel for a warping arrangement. However, with the preferred carrier, as soon as the core moves in a discharge direction, its leading face runs into the angled surface and is lifted. By this motion, the lower end of the freely hanging lever comes into contact with the lower portion of the core wall with the consequence that a clamping of the core occurs.

When the spool is spent, the axial force on the core ceases. The front face then reverses itself and descends the angled surface to the at rest position, whereby the lower end of the lever comes free from the core wall. When the carrier arm is then tipped downwardly, the lever retains its vertical orientation and thus increases its distance from the core wall. Thus, when the tipping increases and the core face rides over the angled surface, it can do so without interference from the lever. The empty core thus can fall from the carrier arm by itself without further assistance.

Because the preferred core holder does not require any spring loading, the arrangement can be produced much less expensively than known spool holders. Furthermore, since no stripping arrangement is necessary on the creel, there are further cost savings.

Preferably, the angled surface has an indentation for taking up the inner flange on the front face of the core. This indentation defines the at rest position of the spool. When the spool is placed onto the spool holder there is a common at rest position for all spools.

Also preferably, the angled surface is frusto-conical. This gives rise to a better fit to the curled front face of the core.

In a preferred embodiment, the indentation is formed as a circumferential groove for the take-up of the inner flange, which is formed as a curled surface. Such a curled edge finds a safe harbor in the annular groove.

It is advantageous for the lever to be located close to the angled surface. This provides for the most efficient utilization of the lift of the core caused by the angled surface.

It is particularly advantageous to provide two levers of different lengths, of which the shorter would be used for a conical core and the longer for a cylindrical core. One and the same construction can therefore be used for two different types of cores.

BRIEF DESCRIPTION OF THE DRAWINGS

The invention may be more fully appreciated by reference to the following figures showing the preferred embodiments.

DETAILED DESCRIPTION OF THE PREFERRED EMBODIMENTS

Figure 1:
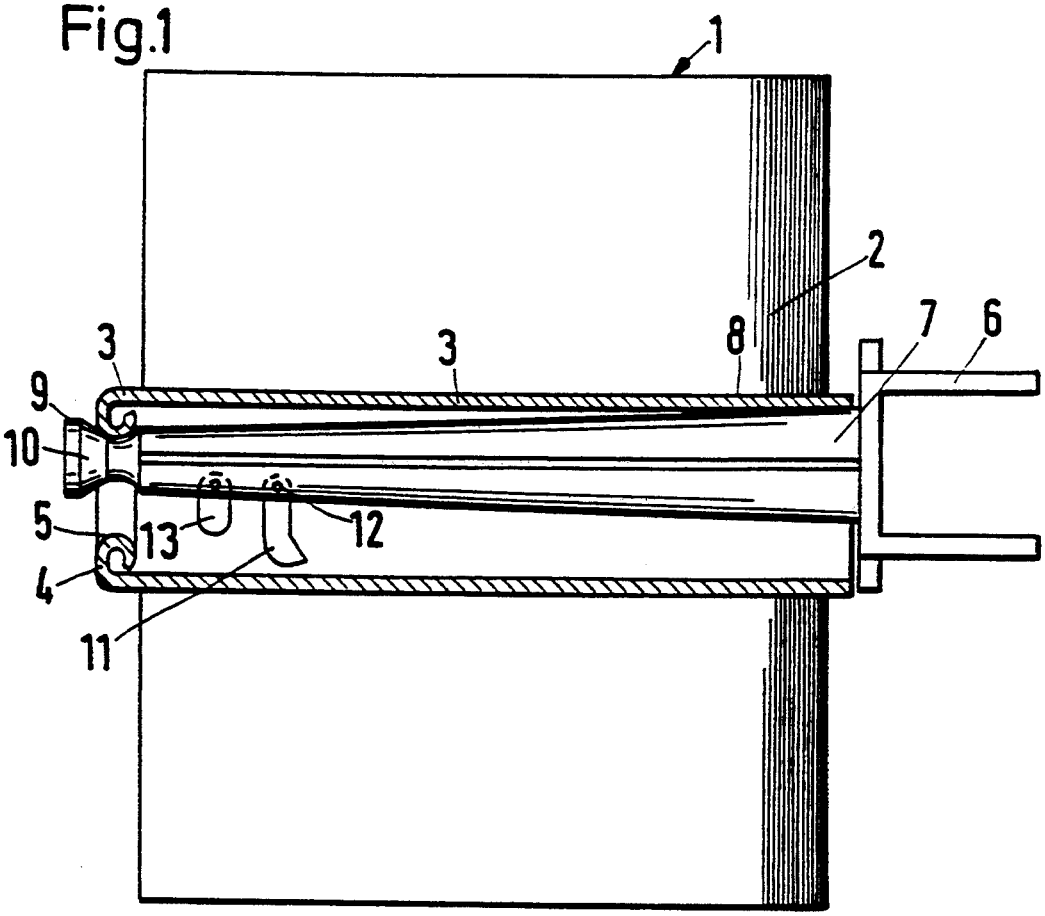
FIG. 1 is a side elevational view in partial cross-section showing a thread spool with a cylindrical core after being loaded onto a carrier in accordance with the principles of the present invention.

Embodiments of FIGS. 1 through 4 show a thread spool whose winding 2 is carried by a cylindrical core 3. The distal face of core 4 is provided with an inwardly curled, inner flange 5.

A carrier arm 7 is attached to a support structure 6, which is mounted to swing down in the manner described presently. Arm 7 can be a tapered rod, having notched circular cross-section, a cruciform, or other cross-section. The upper portion of the proximate end of arm 7 constitutes a support surface 8 for supporting core 3. The distal end of arm 7 has an indentation in the form of a circumferential groove 9 for receiving inwardly directed flange 5. Flange 5 is a curled lip sized to fit into groove 9. Adjacent and integral to groove 9 at the distal end of carrier arm 7 is frusto-conical surface or abutment 10.

A pair of differently sized levers or support elements pivotally depend from arm 7. The upper end of longer lever 11 is attached to carrier arm 7 by hinge 12 and hangs free downwardly by virtue of gravitational force. Lever 11 has a backward jog or dog that change the aspect of it slower surface for facilitating the operations described presently. Adjacent to lever 11 is a similarly mounted shorter lever 13. Levers 11 and 13 can be mounted in cavities or grooves on the underside of arm 7.

Figure 2:
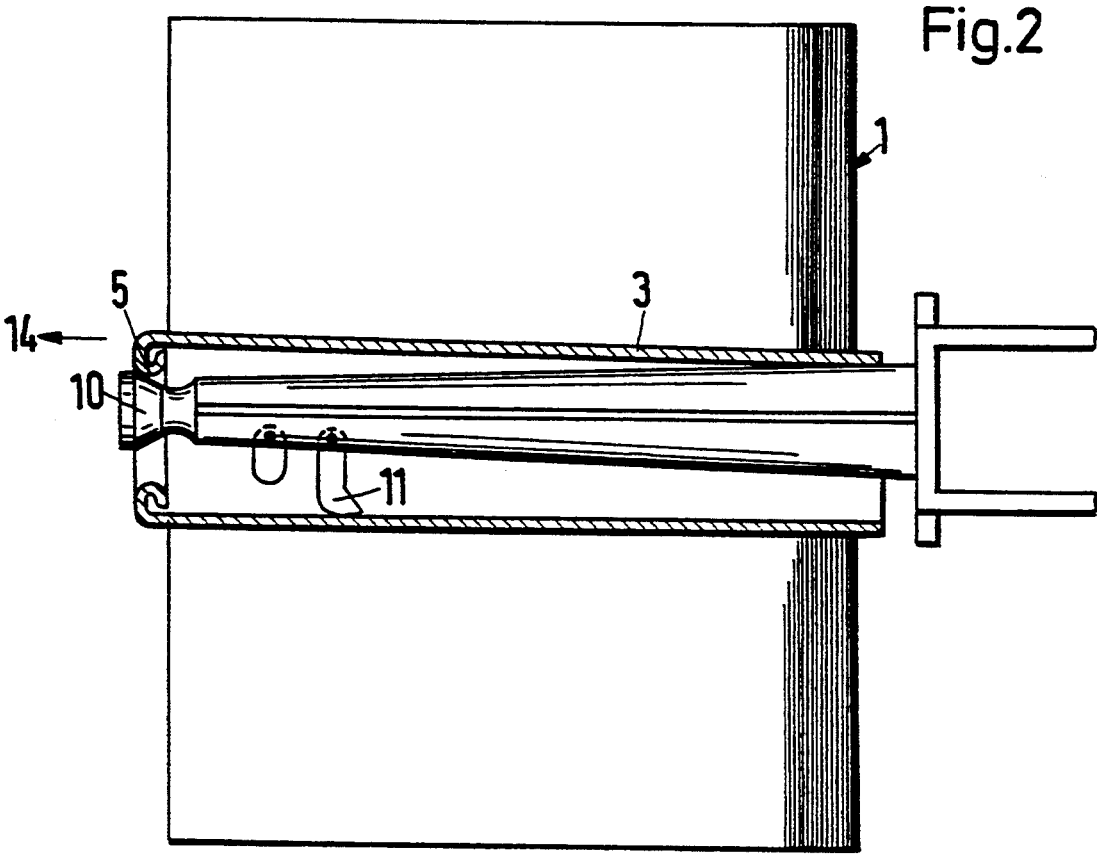
FIG. 2 is a side elevational view in partial cross-section showing the same spool with the core in the clamped position.
Figure 3:
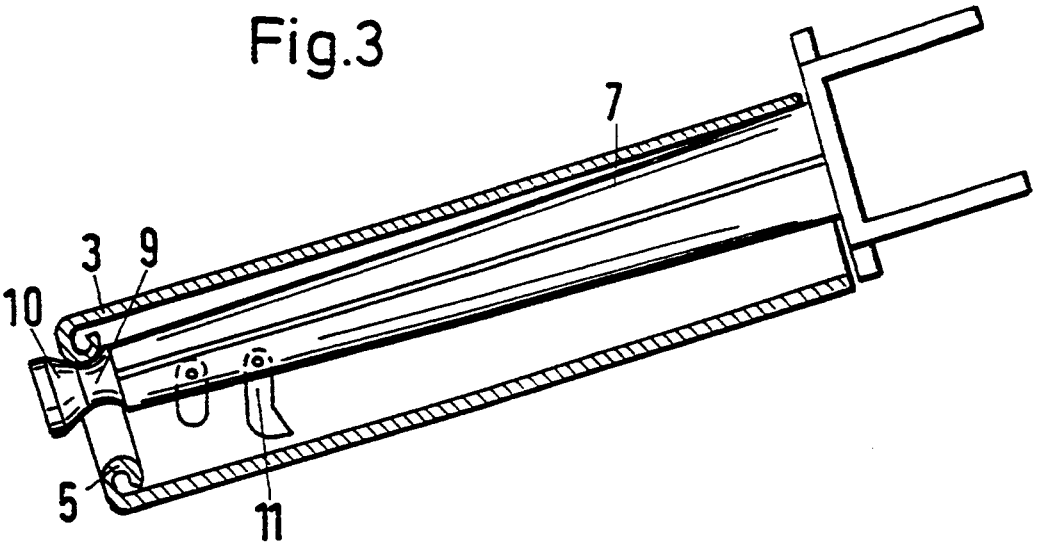
FIG. 3 is a side elevational view in partial cross-section showing the empty core at the beginning of the discharge procedure.

During the thread consumption stage, when spool 1 is being subjected to the axial pulling force indicated by arrow 14 in FIG. 2, the entire spool 1 moves to the left. This motion causes inner flange 5 to climb the angled surface 10. This causes the lower end of lever 11 to contact the bottom, inside core 3. The core is thus locked on the spool holder and is securely stopped in this manner.

Figure 4:
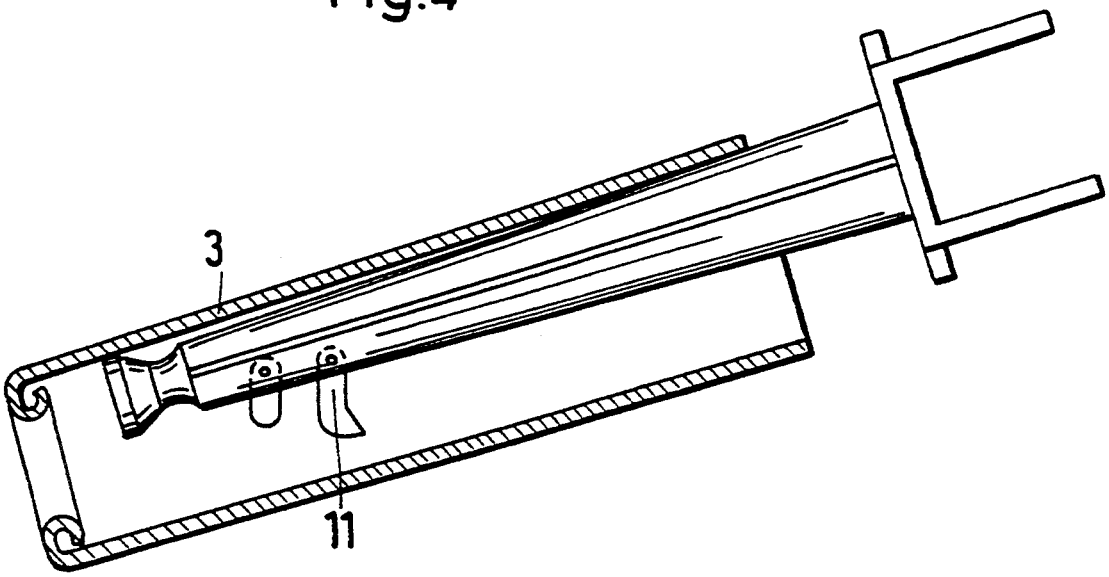
FIG. 4 is a side elevational view in partial cross-section showing the empty core being discharged.

When the spool is empty, the axial force acting thereon ceases. The inner flange 5 of core 3 then slides back down the angled surface 10 into the circumferential groove 9. When the holder reaches a lower turning roller as is the case in a circulating lever 11 maintains its vertical orientation. This increases the distance between the lever 11 and the lower wall 3 (see FIG. 3). The inner flange 5 can readily ride over the angled surface 10 then without renewed blocking of the core (FIG. 4). Thus, the empty housing already falls off when the angle relative to the horizontal is 40 to 45.

Figure 5:
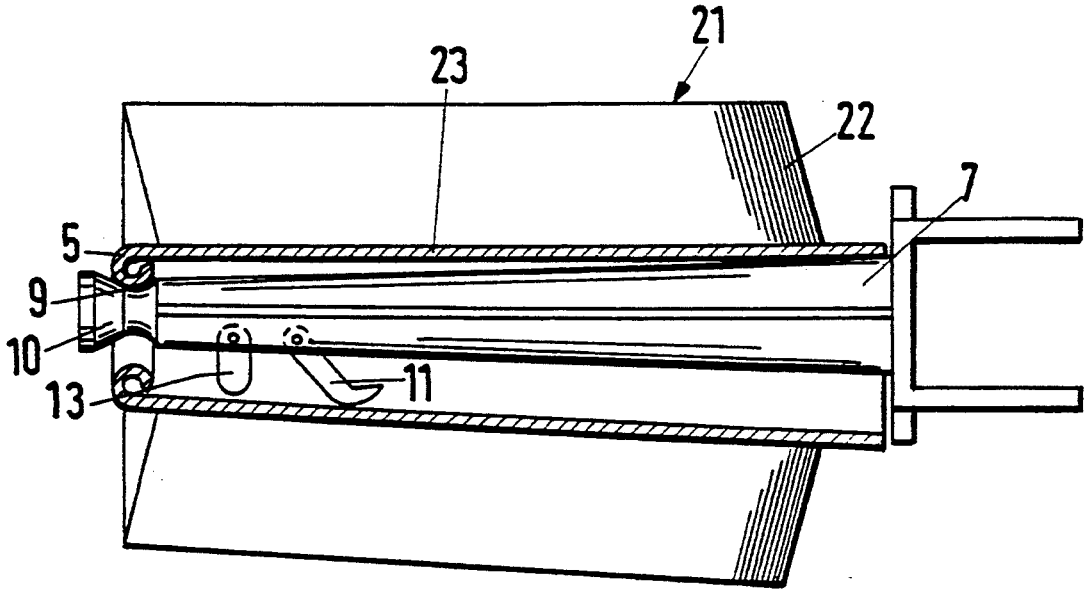
FIG. 5 shows a side elevational view in partial cross-section showing a thread spool with a conical core in the at rest position.
Figure 6:
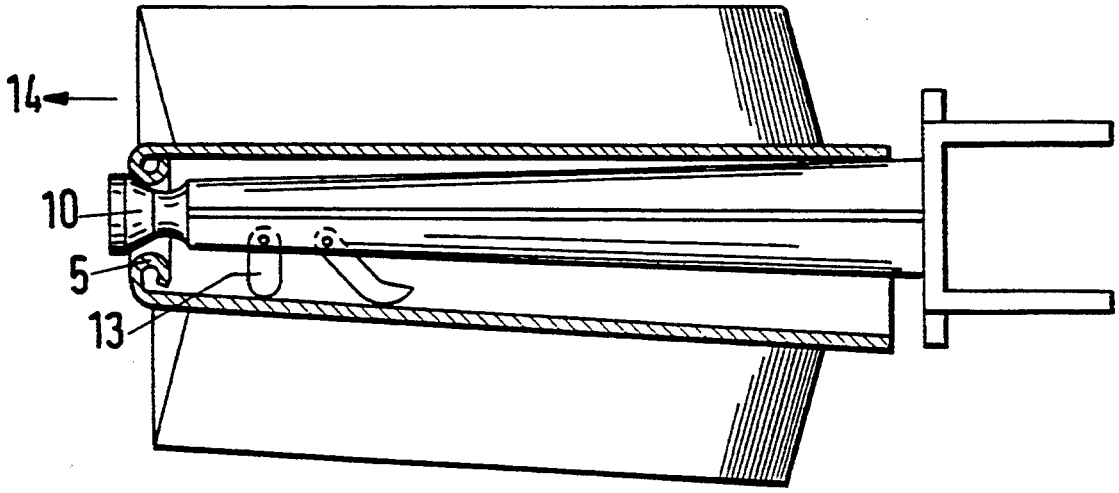
FIG. 6 is a side elevational view in partial cross-section showing the same spool in the clamped position.

FIGS. 5 and 6 show the circumstances existing in a thread spool 21 whose winding 22 rests on a conical core 23. Because of the smaller cross-section of conical housing 23, the longer lever 11 stays in an angular orientation in which it is not influential for clamping purposes. The shorter lever 13, on the other hand, serves as is shown in FIG. 6, as a clamping element when, as a result of the axial take off forces(arrow 14), the inner flange 5 is lifted onto the angled surface 10.

Even here, the inner flange 5 drops back into the circumferential groove 9 once the tension forces are relaxed. The empty core can be disposed of in a similar manner as was shown in conjunction with FIGS. 3 and 4 and described therein.

I claim:

1. A spool carrier for supporting thread spools having either a cylindrical or conical core, said core having an inner core wall terminating in a distal edge, comprising:

a carrier arm, adapted to be used in a horizontal orientation by being cantilevered to extend outwardly, and having a support surface for supporting the inner core wall in an outwardly extended orientation, said carrier arm having an abutment for engaging the distal edge of the core, the abutment having an inclined surface which diverges in a distal direction along said carrier arm; and at least one support element for interacting with a bottom portion of the inner core wall, the support element including:

at least one freely hanging lever having an upper end hinged in the carrier arm and being sized in length to interact with the inner core wall in response to the distal edge of the core climbing the abutment.

2. A spool carrier in accordance with claim 1, wherein the distal edge of the core has an inwardly directed flange, said abutment having an indentation for engaging the inwardly directed flange of the distal edge of said core.

3. A spool carrier in accordance with claim 2, wherein the abutment has a frustro-conical surface.

4. A spool carrier in accordance with claim 3, wherein the distal edge of the core has a curl and wherein said indentation is formed as an annular groove for receiving the curl of the inner flange.

5. A spool carrier in accordance with claim 4, wherein said at least one freely hanging lever is located proximate to the abutment.

6. A spool carrier in accordance with claim 6, wherein said at least one freely hanging lever comprises:

a pair of levers of different lengths, the shorter one of said pair of levers being sized to engage the core if conical, the longer one of said pair of levers being sized to engage the core if cylindrical.

7. A spool carrier in accordance with claim 1, wherein the abutment has a frustro-conical surface.

8. A spool carrier in accordance with claim 1, wherein said at least one freely hanging lever is located proximate to the abutment.

9. A spool carrier in accordance with claim 1, wherein said at least one freely hanging lever comprises:

a pair of levers of different lengths, the shorter one of said pair of levers being sized to engage the core if conical, the longer one of said pair of levers being sized to engage the core if cylindrical.

* * * * *